US007584964B2

(12) United States Patent
Wiggins

(10) Patent No.: US 7,584,964 B2
(45) Date of Patent: Sep. 8, 2009

(54) MONEY COUNTING/MONEY FACT BOARD GAME APPARATUS AND METHOD

(76) Inventor: Carmiletta C. Wiggins, 235 E. 95th St., #6C, New York, NY (US) 10128

( * ) Notice: Subject to any disclaimer, the term of this patent is extended or adjusted under 35 U.S.C. 154(b) by 1 day.

(21) Appl. No.: 11/696,775

(22) Filed: Apr. 5, 2007

(65) Prior Publication Data

US 2007/0200295 A1 Aug. 30, 2007

(51) Int. Cl.
*A63F 3/00* (2006.01)

(52) U.S. Cl. ..... 273/256; 273/278
(58) Field of Classification Search ..... 273/256, 273/257, 279, 278
See application file for complete search history.

(56) References Cited

U.S. PATENT DOCUMENTS

| | | | | |
|---|---|---|---|---|
| 2,998,126 | A * | 8/1961 | Jenkins | 206/0.83 |
| 4,752,227 | A * | 6/1988 | Yamin | 434/110 |
| 4,824,117 | A * | 4/1989 | Russell | 273/248 |
| 5,011,158 | A * | 4/1991 | Roberts et al. | 273/256 |
| 5,193,814 | A * | 3/1993 | Koch | 273/242 |
| 5,503,399 | A * | 4/1996 | Honeywill | 273/243 |
| 5,516,111 | A * | 5/1996 | Strickland, Jr. | 273/269 |
| 6,443,453 | B1 * | 9/2002 | Wallice | 273/243 |
| 6,572,110 | B1 * | 6/2003 | Knott | 273/257 |

* cited by examiner

*Primary Examiner*—Vishu K. Mendiratta
(74) *Attorney, Agent, or Firm*—Walter J. Tencza, Jr.

(57) ABSTRACT

An apparatus including a board for playing a game is provided, the board typically including a plurality of spaces. Each of the plurality of spaces has a depiction of a person who appears on a monetary item. The monetary item may be a coin or a bill. The board may include a square of spaces, each of which has a childhood depiction of a person who appears on a monetary item. The board may also include a ring of spaces, each of which has an adult depiction of a person who appears on a monetary item.

18 Claims, 3 Drawing Sheets

MONEY COUNTING/MONEY FACT BOARD GAME APPARATUS AND METHOD

FIELD OF THE INVENTION

This invention relates to improved methods and apparatus concerning board games particularly board games which relate to finances.

BACKGROUND OF THE INVENTION

There are various board games known in the prior art which use play money.

SUMMARY OF THE INVENTION

The present invention in one or more embodiments provides an apparatus comprising a board for playing a game. The board typically includes a plurality of spaces. Each of the plurality of spaces has a depiction of a person who appears on a monetary item. The monetary item may be a coin or a bill.

The board may include a first side, a second side, a third side, and a fourth side, which together substantially form a square. Each of the first side, the second side, the third side, and the fourth side typically include a plurality of spaces. Each of the plurality of spaces of the first, second, third, and fourth sides typically include a depiction of a person. One or more of the plurality of spaces of the first, second, third, and fourth side may also include a general designation such as "US Money", "Int'l Money" (international money), and/or "M&M wild".

The board may include a plurality of further spaces arranged in a ring. Each of one or more spaces of the plurality of further circled spaces may have a depiction of a person who appears on a monetary item.

Each of the depictions of the one or more circled spaces of the plurality of further spaces arranged in a ring may be adult depictions of a person who appears on a monetary item. Each of the depictions of the plurality of spaces of the first, second, third, and fourth sides may be childhood depictions of a person who appears on a monetary item.

At least one embodiment of the present invention may include a method comprising using a board to play a game. The board may include a plurality of spaces and a plurality of further spaces as previously described.

DETAILED DESCRIPTION OF THE DRAWINGS

Figure 1:
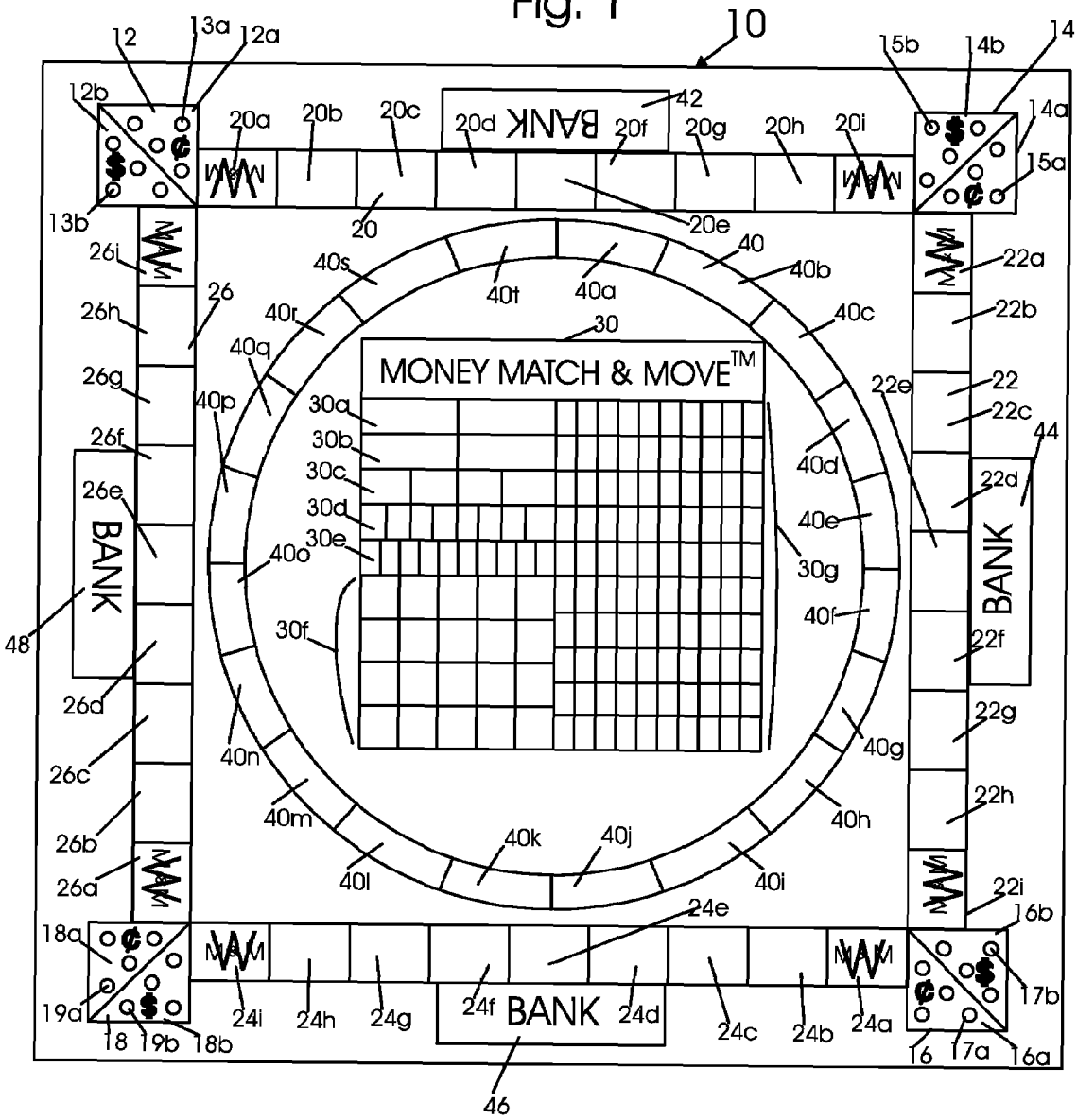
FIG. 1 shows a diagram of a board for a game for use in accordance with an embodiment of the present invention.

FIG. 1 shows a diagram of a board 10 for a game for use in accordance with an embodiment of the present invention.

The board 10 includes large rectangular areas 12, 14, 16, and 18, and sides 20, 22, 24, and 26. The rectangular areas 12, 14, 16, and 18 include triangular landing areas or spaces 12*a-b,* 14*a-b,* 16*a-b,* and 18*a-b* respectively. The sides 20, 22, 24, and 26 include rectangular landing areas or spaces 20*a*-20*i*, 22*a*-22*i*, 24*a*-24*i*, and 26*a*-26*i*, respectively.

Each of the triangular landing areas 12*a*, 14*a*, 16*a*, and 18*a* have a cents character on them, and each can be called a cents start base. Each of the triangular landing areas 12*a*, 14*a*, 16*a*, and 18*a*, include four holes, which are identified as 13*a*, 15*a*, 17*a*, and 19*a*, respectively.

Each of the triangular landing areas 12*b*, 14*b*, 16*b*, and 18*b* have a dollar character on them, and each can be called a dollar finish base. Each of the triangular landing areas 12*b*, 14*b*, 16*b*, and 18*b* include four holes, which are identified as 13*b*, 15*b*, 17*b*, and 19*b*, respectively.

The rectangular landing areas, or spaces 20*a* -20*i*, 22*a*-22*i*, 24*a* -24*i*, and 26*a*-26*i* may be called border spaces and each of these spaces may include a picture or depiction, such as a childhood depiction or picture of a president or other person who appears on a monetary item, such as a particular coin or bill. In one embodiment the depictions in the spaces of sides 20, 22, 24, and 26 include childhood depictions of people on currency, such as a childhood depiction of Abraham Lincoln (who appears on a U.S. penny coin). In addition each of spaces 20*a*-20*i*, 22*a*-22*i*, 24*a* -24*i*, and 26*a*-26*i* may have a color coded background. The colors used for the backgrounds may include red, orange, yellow, blue, indigo, violet, and green. The spaces 20*a*-20*i*, 22*a*-22*i*, 24*a* -24*i*, and 26*a*-26*i* may have a depiction and a background as shown below:

20*a*: M&M wild depiction, green background.

20*b*: Abraham Lincoln/penny depiction, red background.

20*c*: Thomas Jefferson/nickel depiction, orange background.

20*d*: U.S. Money $,¢ depiction, green background.

20*e*: Franklin D. Roosevelt/dime depiction, yellow background.

20*f*: International Money $ ¢ depiction, green background.

20*g*: George Washington/quarter depiction, blue background.

20*h*: John F. Kennedy/fifty cent depiction indigo background.

20*i*: M&M Wild depiction,—green background.

22*a*: M&M Wild depiction green background.

22*b*: Sacagawea/dollar coin depiction,—violet background.

22*c*: Susan B. Anthony/dollar coin depiction,—red background.

22*d*: U.S. Money $ ¢ depiction,—green background.

22*e*: Dwight D. Eisenhower/dollar coin depiction,—orange background.

22*f*: International Money $ ¢ depiction,—green background.

22*g*: George Washington/dollar bill depiction,—yellow background.

22*h*: Thomas Jefferson/two dollar depiction,—blue background.

22*i*: M&M Wild depiction,—green background.

24*a*: M&M Wild depiction,—green background.

24*b*: Abraham Lincoln/five dollar depiction,—indigo background.

24*c*: Alexander Hamilton/ten dollar depiction,—violet background.

24*d*: U.S. Money $ ¢ depiction,—green background.

24*e*: Andrew Jackson/twenty dollar depiction,—red background.

24*f*: International Money $ ¢ depiction,—green background

24*g*: U.S. Grant/fifty dollar depiction,—orange background.

24*h*: Benjamin Franklin/hundred dollar depiction,—yellow background.

24*i*: M&M Wild depiction,—green background.

26*a*: M&M Wild depiction,—green background.

26*b*: William McKinley/five hundred dollar depiction,—blue background.

26*c*: Grover Cleveland/one thousand dollar depiction,—indigo background.

26*d*: U.S. Money $ ¢ depiction,—green background.

26*e*: James Madison/five thousand dollar depiction,—violet background.

26*f*: International Money $ ¢ depiction,—green background.

26*g*: Salmon P. Chase/ten thousand dollar depiction,—red background.

26*h*: Woodrow Wilson/one hundred thousand dollar depiction,—orange background.

26*i*: M&M Wild depiction,—green background.

Spaces in sides 20, 22, 24, and 26 having red backgrounds may include spaces which have depictions of an Abraham Lincoln/penny, a Susan B. Anthony/dollar coin, an Andrew Jackson/twenty dollar bill, and a Salmon P. Chase/ten thousand dollar bill. Spaces in sides 20, 22, 24, and 26 having orange backgrounds may include spaces which have depictions of a Thomas Jefferson/nickel, a Dwight D. Eisenhower/dollar coin, a U.S. Grant/fifty dollar, a Woodrow Wilson/one hundred thousand dollar. Spaces in sides 20, 22, 24, and 26 having yellow backgrounds may include spaces which have depictions of a Franklin D. Roosevelt/dime, a George Washington/dollar bill, and a Benjamin Franklin/one hundred dollar bill Spaces in sides 20, 22, 24, and 26 having blue backgrounds may include spaces which have depictions of a George Washington/quarter, a Thomas Jefferson/two dollar bill, and a William McKinley/five hundred dollar bill. Spaces in sides 20, 22, 24, and 26 having indigo backgrounds may include spaces which have depictions of a John F. Kennedy/fifty cent piece, an Abraham Lincoln/five dollar bill, and a Grover Cleveland/one thousand bill. Spaces in sides 20, 22, 24, and 26 having violet backgrounds may include spaces which have depictions of a Sacagawea/dollar coin, an Alexander Hamilton/ten dollar bill, and a James Madison/five thousand dollar bill.

For the border spaces (20*a*-20*i*, 22*a*-22*i*, 24*a* -24*i*, and 26*a*-26*i*), there may be an actual picture or depiction of the individual whose face appears on the particular monetary item, such as a U.S. coin or U.S. currency, such as a picture or depiction of Andrew Jackson substantially as Andrew Jackson appears on the U.S. twenty dollar bill. Alternatively, or additionally, a space may include both a childhood picture of the person and a picture of the person as he/she appears on a monetary item. For example border space 20*b* may include or have located therein a first picture or depiction which may be childhood picture of Abraham Lincoln and a second picture or depiction which may show Lincoln as he appears on a penny, or may show a depiction of a U.S. Abraham Lincoln penny itself. The M&M wild spaces, such as 20*a* and 20*i*, may simply state or indicate the words and/or letters "M&M wild" and/or a picture or design. The U.S. money spaces, such as 20*d*, 22*d*, 24*d*, and 26*d*, may simply state or indicate the words and/or letters "U.S. Money" and/or may show pictures of a U.S. monetary item, such as a U.S. dollar bill or a U.S. dime.y. The International Money spaces, such as 20*f*, 22*f*, 24*f*, and 26*f*, may simply state or indicate the words and/or letters "International Money" and/or may show pictures of an international monetary item.

The board 10 may also include a currency wheel 40 shown in FIG. 1. The currency wheel 40 may be a ring of twenty spaces 40*a*-40*t*. The currency wheel 40 may have similar color coding to the spaces of the sides 20, 22, 24, and 26. For example, the currency wheel 40 may use background colors similar to the colors used by the spaces of the sides 20, 22, 24, and 26.

The spaces 40*a*-40*t* may have a depiction and background color as shown below:

40*a*: Abraham Lincoln/penny depiction, red background.

40*b*: Thomas Jefferson/nickel depiction, orange background.

40*c*: Franklin D. Roosevelt/dime depiction, yellow background.

40*d*: George Washington/quarter depiction, blue background.

40*e*: John F. Kennedy/fifty cent depiction indigo background.

40*f*: Sacagawea/dollar coin depiction,—violet background.

40*g*: Susan B. Anthony/dollar coin depiction,—red background.

40*h*: Dwight D. Eisenhower/dollar coin depiction,—orange background.

40*i*: George Washington/dollar bill depiction,—yellow background.

40*j*: Thomas Jefferson/two dollar depiction,—blue background.

40*k*: Abraham Lincoln/five dollar depiction,—indigo background.

40*l*: Alexander Hamilton/ten dollar depiction,—violet background.

40*m*: Andrew Jackson/twenty dollar depiction,—red background.

40*n*: U.S. Grant/fifty dollar depiction,—orange background.

40*o*: Benjamin Franklin/hundred dollar depiction,—yellow background.

40*p*: William McKinley/five hundred dollar depiction,—blue background.

40*q*: Grover Cleveland/one thousand dollar depiction,—indigo background.

40*r*: James Madison/five thousand dollar depiction,—violet background.

40*s*: Salmon P. Chase/ten thousand dollar depiction,—red background.

40*t*: Woodrow Wilson/one hundred thousand dollar depiction,—orange background.

The spaces 40*a*-40*t* may include an adult depiction of a person who appears on a currency. The adult depiction may be substantially the same as a depiction which typically appears on the particular currency.

For example, space 40*a* of the currency wheel 40 may have a depiction of a U.S. penny, front (Abraham Lincoln) and back (Lincoln Memorial). Space 40*a* may have a depiction of the front of the U.S. Abraham Lincoln penny, the back, or both depictions of the front and the back side by side or with one on top and one underneath in the same space 40*a*. The space 20*b* of side 20 may have a depiction of Abraham Lincoln as a child cutting logs. Both space 20*b* and 40*a* may have a red background. Space 40*b* of currency wheel 40 may have a depiction of the front of the U.S. nickel (Thomas Jefferson) and/or the back of the nickel (Monticello) and space 20*c* of side 20 may have a depiction of Thomas Jefferson, as a child, playing a violin. Both spaces 20*c* and 40*b* may have an orange background.

The use of childhood depictions and adult depictions may be used as a visual stimuli to compare the president/people as children (typically in depictions in sides 20, 22, 24, and 26) with the president/people as adults (typically in depictions in color wheel 40). For example, space 20*b* on the child president/people border (sides 20, 22, 24, and 26) may have a depiction of Abraham Lincoln as a child cutting logs. The other red background childhood spaces (of sides 20, 22, 24, and 26) may contain depictions of Susan B. Anthony, Andrew Jackson and Salmon P. Chase as children. The four red background spaces on the wheel 40, in one embodiment, will have depictions of the same people, however as adults. A Money Fact question may ask, "Which child with a red background on the border spaces (of sides 20, 22, 24, and 26) became the $16^{th}$ president of the United States on a red background on the adult people currency wheel 40? Of course, the answer would be Abraham Lincoln. The currency wheel 40 may be on the board 10 or it may be a hand-held separate piece.

The board 10 also includes a center section 30 shown in FIG. 1 The center section 30 is located in the middle of the board 10 and may be called the "Match & Move Coin Guide". It may swivel so that each player can have access to it, and read it easily, as they Match & Move coins to play the game. In one embodiment, the center section 30 may include the same color coded seven background colors as the currency wheel 40 and the border spaces of the sides 20, 22, 24, and 26. Alternatively, or additionally, the entire section 30 may have a solid green color. The center section 30 or "Match & Move Coin Guide" 30 is comprised of sections 30*a-g*. The sections 30*a-g* are split into further sections or sub-sections. The sections 30*a-g*, together may represent seven dollars and ninety-five cents. The section 30*a* for dollar coins, may have a first background color, such as violet, and may be split into two further sections or subsections. Each of the further sections or subsections of 30*a* may have a picture of a dollar coin shown or printed thereon.

The section 30*b* for fifty-cent pieces, may have a second background color, such as indigo, and may be split into two sections or subsections. Each of the further sections or subsections of 30*b* may have a picture of a fifty cent piece shown or printed thereon. The section 30*c* for quarters, may have a third background color, such as blue, and may be split into four further sections or subsections. Each of the further sections or subsections of 30*c* may have a picture of a quarter shown or printed thereon. The section 30*d* for quarter/dime exception may have a fourth background color, such as green, and may have a picture of a quarter shown or printed in a first square or subsection, followed by seven subsections each of which may have a picture of a dime shown or printed thereon.

The section 30*e* for dimes, may have a fifth background color, such a yellow, and may be split into ten further sections or subsections. Each of the further sections or subsections of section 30*e*, may have a picture of a dime shown or printed thereon. The section 30*f* for nickels, may have a sixth background color such as orange, and may be split into twenty further sections or subsections. Each of the further sections or subsections of section 30*f* may have a picture of a nickel shown or printed thereon. The section 30*g* for pennies, may have a seventh background color, such as red, and may be split into one hundred further sections or sub-sections. Each of the subsections of section 30*g* may have a picture of a penny shown or printed thereon.

The title, "MONEY" shown in the section 30, may have green letters with silver and green glitter and the title "MATCH & MOVE", may have all seven rainbow colors (used for the border spaces of sides 20, 22, 24, and 26) with silver glitter.

Figure 2:
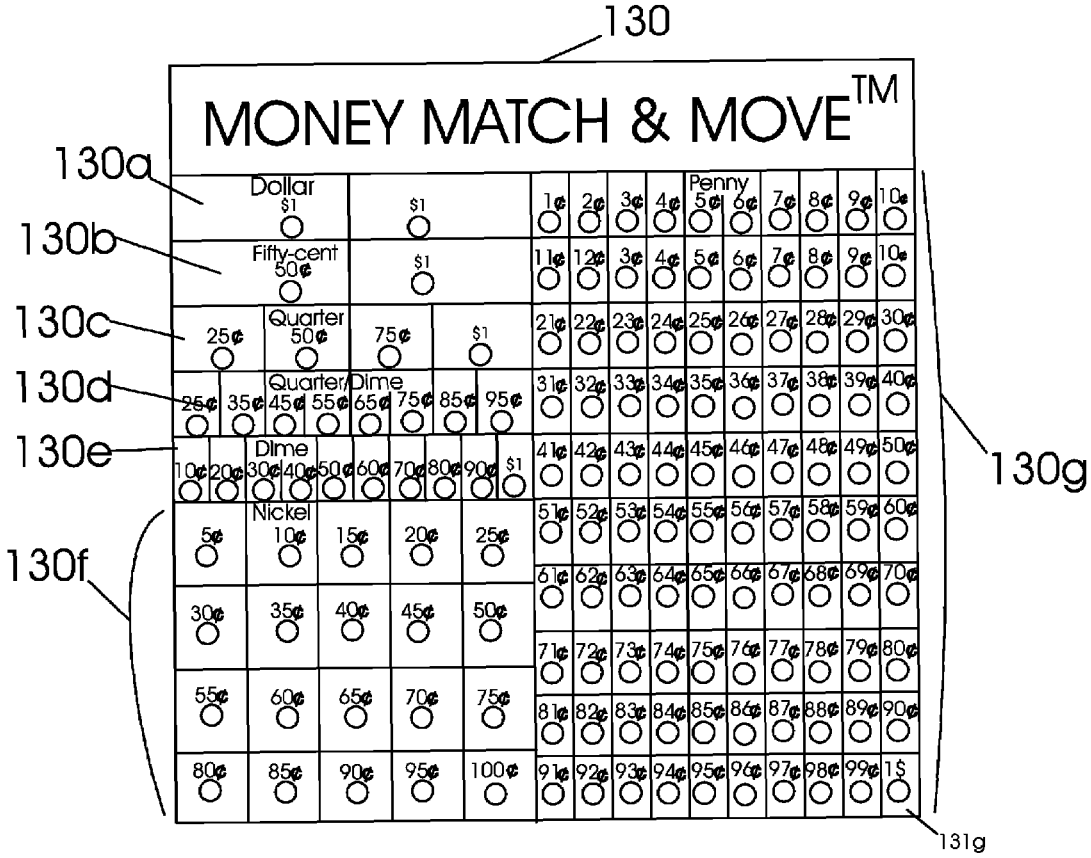
FIG. 2 shows a diagram of a possible section for a board such as the board in FIG. 1.

The section 30 may be replaced, or may include the information shown by a section 130 shown in FIG. 2. Section 130 includes sections 130*a-g*. Each section of sections 130*a-g* may have a title or label. Sections 130*a-g* may have labels of "Dollar", "Fifty-cent", "Quarter", "Quarter/Dime", "Dime", "Nickel", and "Penny", respectively. In FIG. 2, circles are shown in each of the sections 130*a-g*. Each of the circles may have a depiction of a front and/or back of a coin. For example, the first circle in the "Dollar" section 130*a* may have a depiction of a front of a dollar coin, while the second circle in the "Dollar section 130*a* may have a depiction of a back of a dollar coin. Similarly, the sections 130*b-g*, may have depictions of the appropriate fronts and/or backs of coins shown where the circles are located. The fronts and backs of coins may alternate. Sections 130*b-g*, would have depictions of fifty-cent pieces, quarters, quarter or dimes, dimes, nickels, and pennies, respectively.

Section 130*a* shows a "$1" value above either of first two circles. For sections 130*b-g*, each of the circles in a section may have an indication of cumulative value for that circle for that section shown above the circle. For example, "50¢" appears above the first circle in section 130*b* indicating a fifty cents cumulative value, while "$1" appears above the second circle in section 130*b* indicating one dollar in cumulative value. Similarly "25¢", "50¢", 75¢" and $1 appear above the first, second, third, and fourth circles, respectively, in the section 130*c*.

Sections 130*a-g* may have background colors of violet, indigo, blue, green, yellow, orange, and red, respectively, with sparkles of the same color.

The coins depictions in section 130 are typically replicas of the actual coin. The circles may be a thin circle around the inner edge of the circle having the depiction of the particular actual coin. Circles in the coin guide or sections 30 or 130 may be color coded according to the colors of the section name, as described previously. Typically the section 30 or 130 use the identical seven colors previously referred to for the particular coins to aid in the counting process. Each depiction of a coin (which are shown as circles in FIG. 2 in the sections 130*a*-130*g*) typically is surrounded by a background color: pennies (shown as circles in section 130*g*), nickels (shown as circles in section 130*f*), dimes (shown as circles in section 130*e*), quarters/dimes (shown as circles in section 130*d*), quarters (shown as circles in section 130*c*), fifty cent pieces (shown as circles in section 130*b*), and dollar coins (shown as circles in section 130*a*) may be surrounded by background colors of red, orange, yellow, green, blue, indigo, and violet, respectively.

Figure 3:
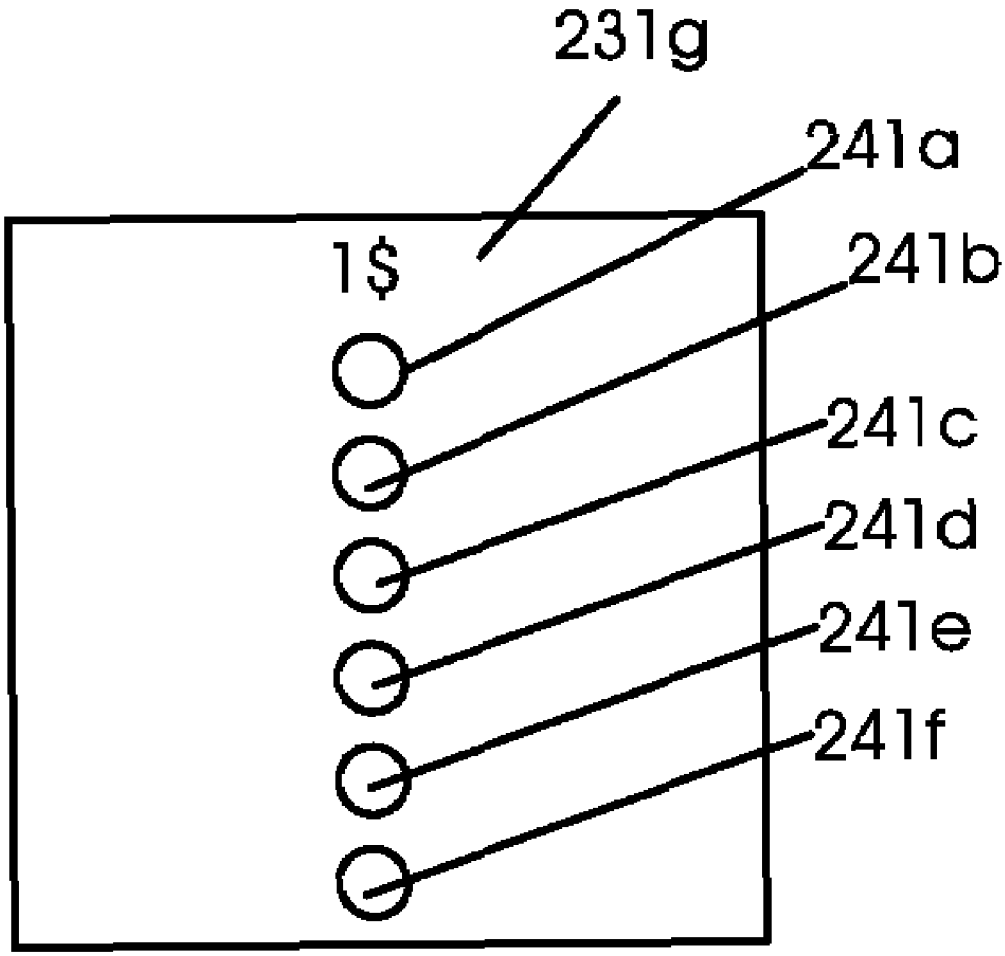
FIG. 3 shows a diagram of a possible section or subsection to be used in the possible section of FIG. 2.

The penny section, such as section 130*g*, may be further color coded to reflect multiples of five which are orange, the same color as the background color for nickels; multiples of ten which are yellow, the same color as circles in the dimes section 130*e*, multiples of twenty-five which are blue, the same color as the circles in the quarters section 130*c*, multiples of fifty which are indigo, the same color as the fifty cents, and multiples of one hundred, like the dollar coin, violet. For example, section 131g of section 130*g* shown in FIG. 2, labeled "$1," under the penny section 130*g* can be replaced by or may include block or section 231*g* shown in FIG. 3. Block or section 231*g* shown in FIG. 3 may include circles 241*a-f*. Circles 241*a-f* may be colored red (for penny), orange (for nickel), yellow (for dime), blue (for quarter), indigo (for fifty-cent piece), and violet (for dollar), respectively.

Similarly, in the penny section, such as 130*g*, all multiples of five (five, ten, fifteen, twenty, . . . one hundred)) may have at least two circles. In addition to having the original red circle for the penny, these multiples may have an additional orange circle for being a multiple of five. All multiples of ten (ten, twenty, thirty, forty, fifty, sixty, seventy, eighty, ninety, and one hundred) may have at least three circles. In addition to having the original red circle for the penny, they may have an orange circle for being a multiple of five, and a yellow circle for being a multiple of ten. All multiples of twenty-five (twenty-five, fifty cents, seventy-five cents, and one hundred) may also have at least 3 circles. In addition to having the original red circle for the penny, they may have an orange circle for being a multiple of five, and a blue circle for being multiple of twenty-five. All multiples of fifty (fifty and one hundred) may have at least five circles. In addition to having the original red circle for the penny, they may have an orange circle for being a multiple of five, a yellow circle for being a multiple of ten, a blue circle for being a multiple of twenty-five, and an indigo circle for being a multiple of fifty. All multiples of one hundred will have an additional violet circle, for a total of six circles.

In the "Nickel" section 130*f* shown in FIG. 2, in addition to having the original orange circle inside, all multiples of ten (ten, twenty, thirty, forty, fifty, sixty, seventy, eighty, ninety and one hundred) may also have a yellow circle.

In the "Dime" section 130*e* shown in FIG. 2, in addition to having the original yellow circle inside, all multiples of fifty (fifty and one hundred) may also have an indigo circle in it. In the "Quarter" section 130*c*, in addition to having the original blue circle inside, all multiples of fifty (fifty and one hundred) may also have indigo in it. One hundred may have a violet circle for a multiple of one hundred. In the fifty-cent section 130*b* in addition to having the original blue circle, the fifty and one hundred may also have color circles for the multiples of fifty. One hundred may have a violet circle for a multiple of one hundred. In the 130*a* dollar section, there may only be a violet circle around the first coin (front).

These are examples of how the coin colors on the coin guide or section 30 or 130, the adult president/people wheel 40, and the child president/people spaces of spaces in sides 20, 22, 24, and 26 in FIG. 1, can be color coded and how they can match. The background color for the penny section, such as section 130*g* and the thin circle in each penny in the penny section 130*g* on the coin guide or section 130 can be red, while the corresponding space for the front and back of a penny on the currency wheel 40 can be red, and the space containing Abraham Lincoln's child picture in the appropriate spaces of sides 20, 22, 24, and 26, can be red. The three colors can match. Similarly, the background color for the nickel section 130*f* and the thin circle in each nickel in the nickel section 130*f* on the coin guide 130 of FIG. 2 can be orange, while the space for the front and back of nickel on the currency wheel 40 can also be orange, and the space containing Thomas Jefferson's child picture in the appropriate spaces of sides 20, 22, 24, and 26 can be orange. The three colors can match. Also, the background color for the dime section 130*e* and the thin circle in each dime in the dime section 130*e* on the coin guide 130 can be yellow, the space for the front and back of dime on the currency wheel 40 can be yellow, and the space containing Franklin D. Roosevelt's child picture in the appropriate spaces of sides 20, 22, 24, and 26 can be yellow. The three colors can match. Moreover, the background color for the quarter section 130*c* and the thin circle in each quarter in the quarter section 130*c* on the coin guide 130 can be blue, the space for the front and back of the quarter on the currency wheel 40 can be blue, and the space containing George Washington's child picture in the appropriate spaces of sides 20, 22, 24, and 26 can be blue. The three colors can match.

The board 10 can be used to play a game called "Money Match & Move" in accordance with one or more embodiments of the present invention. In one embodiment, two to four players can play the game. The rules for the game may provide for a "Match & Move" monitor, who may be a parent, grandparent, sibling, friend or classmate. The monitor may provide assistance if needed. The game may be played by players five years old and up. The game incorporates another way to count money and may teach children how to count money while they learn fun and interesting facts about money and about the president/people on monetary items. This other way of counting money is based on the matching relationships that monetary items share. The game, in at least one embodiment, uses a simple technique of matching and moving coins on a Coin Guide, such as section 30 or 130, that always leads children to the correct answer. One of the objectives of the game may be for each player to earn money to purchase what they want. Players may answer "Money Counting" questions and "Money Fact" questions. Players may draw cards. The game may be played using money pieces such as a penny, nickel, dime, quarter, etc.

Players answer questions based on a CAN (Choice Answer Number) from "1" to "4" ("1" meaning, I can do it, but I need help to "4", meaning, I can do it. I know the answer). Depending on their answer, money is either deposited into or debited from their game bank and based on the (CAN) Choice Answer Number ("1" TO "4") chosen, they move their Money Pieces 1 to 4 spaces, counterclockwise, along a border from the Cent Start Base such as landing space 16*a*, to the Dollar Finish Base, such as landing space 18*b*, shown in FIG. 1. The border, or substantially square set of spaces may include sides 20, 22, 24, and 26. The sides 20, 22, 24, and 26 may include spaces containing pictures of presidents when they were children, a "U.S. Money" designation, an "Int'l Money" designation and "Match & Move Wild" spaces. Giving children the option to choose how they wish to answer is yet another confidence building factor of a game in accordance with an embodiment of the present invention because they are in control as they learn.

How the Game is Played:

There are seven game phases in one embodiment of the present invention:

A. The Setup;
B. The Main game;
C. The Count;
D. The Exchange;
E. The Purchase;
F. The Continuation; and
G. The Awards.

A. The Setup

The Setup phase is typically comprised of the following steps: (1) determining the Game Level 1 to 4, (2) determining the number of Money Pieces 1 to 4, (3) depositing money into each player's bank, (4) selecting category cards, (5) rolling a 6-sided Coin Die, and (6) selecting the item in the category to play for.

For step (1) of the setup, depending on the player's age and experience, the players can play on 1 to 4 levels: Level 1 asks money counting questions from numbers one to ten (three different types of coins are used—dimes, nickels, pennies) and may ask basic "Money Fact" questions; Level 2 asks "Money Counting" questions from numbers ten to twenty-five (four different types of coins are used—quarters, dimes, nickels, and pennies) and may ask more advanced "Money Fact" questions; Level 3 asks "Money Counting" questions from numbers twenty to fifty (five different types of coins are used—fifty cents, quarters, dimes, nickels, pennies) and may ask more advanced "Money Fact" questions; Level 4 asks money counting questions from numbers fifty to one hundred (six different types of coins are used—silver dollars, fifty cents, quarters, dimes, nickels, pennies) and may ask more advanced "Money Fact" questions. It may also be decided whether to play a shortened version. The shortened version may include only one round. In the shortened version, after a count and exchange, the game ends with an item being purchased by the player with the Most Money award. Each level may include a Match & Move Monitor, who may or may or may not play the game.

For step (2) of the setup, the game level chosen in step (1) can determine the number of Money Pieces used to move along a border from the Cent Start Base (such as 16*a*) to the Dollar Finish Base (such as 18*b*). Level 1 can use one Money Piece, Level 2 can use two Money Pieces, Level 3 can use three Money Pieces, and Level 4 can use four Money Pieces.

For step (3) of the setup, five of each denomination used in the level may be deposited into each player's bank. On the board 10 shown in FIG. 1, there may be rectangular boxes 42, 44, 46, and 48 with designations "BANK". First, second, third, and fourth players may deposit or locate their money in banks or boxes 42, 44, 46, and 48, respectively. In Level 1, three different types of coins are used (dimes, nickels, pennies), so each player takes five dimes, five nickels and five pennies, totaling 80¢ from a money tray (not shown) and deposits it into their banks, i.e. into or on the appropriate box of 42, 44, 46, and 48 In Level 2, four different types of coins are used (quarters, dimes, nickels, pennies), so each player takes five quarters, five dimes, five nickels and five pennies, totaling $2.05 from the money tray and deposits it into their banks. In Level 3 five different types of coins are used (fifty cents, quarters, dimes, nickels, pennies), so each player takes five fifty cents coins, five quarters, five dimes, five nickels and five pennies, totaling $4.55 from the money tray and deposits it into their banks. In Level 4 six different types of coins are used (silver dollars, fifty cents, quarters, dimes, nickels, pennies), so each player takes five silver dollars, five fifty cents coins, five quarters, five dimes, five nickels and five pennies, totaling $9.55 from the money tray and deposits it into their banks.

For step (4) of the setup, a category is selected from which all players choose a different item to play for. The category cards are placed face down, so that they cannot be seen, and each player selects one category card, and turns it up. The category cards each show one of several categories. The categories may include (a) Movies/DVD, (b) Music/CD, (b) Video Games, (c) Dolls/Action Figures, (d) Books, (e) Toys, (f) Stuffed Animals, (g) Electronics, (h) Clothing, and (i) Game.

For step (5) of the setup, each player rolls a die that may have first, second, third, fourth, fifth, and sixth sides or faces. The first face may have an image of a one dollar coin or one dollar bill. The second face may have an image of a half dollar coin. The third face may have an image of a quarter coin. The fourth face may have an image of a dime coin. The fifth face may have an image of a nickel coin. The sixth face may have an image of a penny coin. The player who rolls the die so that the highest value appears on top, would go first. The category card for the player that rolls the highest value, is the category card that each player will select an item from. The player who rolls the highest value would also typically be first to select a Money Piece. Money Pieces are moved, typically along the spaces of sides 20, 22, 24, and 26 on the board 10. A Money Piece may be a monetary item, such as a dime, quarter, nickel, etc. The player to the right of the player, whose turn it is, is a Reader. The player to the left of the player, whose turn it is, will typically go next.

Regarding step (6), each player decides on the item they wish to play for. The item may be worth twice the amount that is initially deposited in the player's bank. For Level 1, the amount of money placed in the bank may be 80¢ so the item may be worth $1.60. For Level 2, the amount of money placed in the bank may be $2.05 so the item may be worth $4.10. For Level 3, the amount of money placed in the bank may be $4.55 so the item may be worth $9.10. For Level 4, the amount of money placed in the bank may be $9.55 so the item may be worth $19.10.

B. The Main game:

In the main game phase, the current player can move the first Money Piece from the Cent Start Base, such as 16*a*, onto the side 22 of the game board 10 with the first card drawn from either a pile of cards that contain both "Money Counting" cards or "Money Fact" cards. These cards can be kept in a Card Box that is passed around the table. The second and subsequent Money Pieces (for second and subsequent players) can enter the game after the first Money Piece has made it to the Dollar Finish Base, such a space 18*b* on board 10. The exception to the rule is that a different player can only move onto the game board 10, in one embodiment, when a card drawn matches the money piece. As a bonus of a Match & Move Slam!, which occurs when a new piece for a new player gets slammed onto the board 10 or into sides 20, 22, 24, and 26. In one embodiment, these are the only two reasons more than one Money Piece (i.e. more than one player) would be on the board 10 at the same time. A player, whose turn it is (Current Player) draws a card and passes it to the Reader—who may be the player to the right. The next player to go typically is the player to the left of the Current Player. The Reader tells the Current Player what kind of card it is, such as either a "Money Counting" card or a "Money Fact" card.

The "Money Counting" card typically has a question on the top half of the card and an answer on the bottom half of the card, and typically shows a step-by-step "Match & Move" sequence that leads to the answer. The "Money Fact" card typically has a question on the top of the card and answer choices on the bottom of the card. Questions from either type of card begin with the Reader asking the Current Player, "What's your CAN (Choice Answer Number)" in answering this question?" The Current Player would evaluate and respond, "My CAN (Choice Answer Number) is."

The CAN (Choice Answer Numbers) for Money Counting questions are:

1. I can do it, but I need help. Afterwards I will try using Match & Move. I can do it.
2. I can do it using Match & Move.
3. I can do it all by myself. Afterwards, I will use Match & Move to prove my answer.
4. I can do it. Give me the coins in any order. I know the answer!

The CAN (Choice Answer Numbers) for Money Fact questions are:

1. I can do it, but I need help with the answer. Ask me again, and I will tell you the answer.
2. I can do it with 2 choices.
3. I can do it with 3 choices.
4. I can do it! I know the answer!

There may be three types of "Money Counting" cards, such as (1) an All Coins card, (2) a # +Coin Word (1 Penny) or Word # +Coin Word (One Penny), and (3) a Cents card. The (1) All Coins card may specify a number of coins for the Current Player to take from the Money Tray and place on the board 10. The Reader shows the card to the Current Player and asks the Current Player a question such as, "What is your CAN (Choice Answer Number) 1-4 in telling me how much this is?" The (2) # +Coin Word (1 Penny) or Word # +Coin Word (One Penny) may specify a number of coins for the Current Player to take from the Money Tray and place on the board 10. The Reader shows the card to the Current Player and asks the Current Player a question such as, "What is your CAN (Choice Answer Number) 1-4 in telling me how much this is?" The (3) Cents card may specify a number. The Current Player uses the Coin Guide to determine what coins can make up that number. The Current Player takes the coins, as needed, from the Money Tray and places them, as needed on the Coin Guide, such as 30 in FIG. 1 or 130 in FIG. 2. The Reader shows the card to the Current Player and asks the Current Player a question such as, "What is your "What is your CAN (Choice Answer Number) 1-3 in giving me the coins to equal this number?" For each type of question, the Current Player's response is "My CAN (Choice Answer Number) is", followed by the number.

If a "Money Counting" card is drawn and the Current Player answers the question correctly, the coins or value on the card is deposited in the players' bank, and placed into the appropriate bank or box of 42, 44, 46, and 48 on the board 10 and depending on the CAN (Choice Answer Number), the Current Player's Money Piece is moved forward (counterclockwise on the board 10) the number of spaces equivalent to the CAN (Choice Answer Number). For example, if the player knows the answer (i.e. CAN (Choice Answer Number) 4, then the Current Player moves the Money Piece (which may be a dime) counter clockwise four spaces on the board 10 in FIG. 4. For example the Money Piece may move from space 22*h* to space 22*d* in side 22, in order to move four spaces. The triangles, such as 12*a-b,* 14*a-b,* 16*a-b,* and 18*a-b* aren't border spaces. A player when moving his/her Money Piece would jump from space 22*a* to 22*i*, for example, jumping over the triangle pieces 14*a-b.* The two M&M Wild spaces count as two spaces.

If a "Money Counting" card is drawn and the Current Player answers the question incorrectly the coins or value on the card is debited from the players' bank and depending on the CAN (Choice Answer Number), the Current Player moves the Money Piece backward (clockwise on the board 10) the number of spaces equivalent to the CAN (Choice Answer Number).

There may also be three types of "Money Fact" cards, such as (1) a Denomination card (2) a President/Person card or a (3) Money Wheel card. The (1) Denomination card may ask a question about that particular denomination. The (2) President/Person card may ask a question about the president or person's life. The Money Wheel card may ask a visual question about the child who became the president/person shown on a particular monetary item, such as a coin or bill. The Reader tells the Current Player which type of card it is and asks the Current Player a question such as, "What is your CAN (Choice Answer Number) 1-4 in answering this question?" The Current Player's response is "My CAN (Choice Answer Number) is", followed by the number.

If a "Money Fact" card is drawn and the Current Player answers the question correctly, the player rolls the Coin Die and depending on the CAN (Choice Answer Number), that number of coins is deposited into the players' bank (placed into one of 42, 44, 46, or 48) and the Money Piece is moved forward, counterclockwise on the board 10, the number of spaces equivalent to the CAN (Choice Answer Number).

If a "Money Fact" card is drawn and the Current Player answers the question incorrectly, the player rolls the Coin Die and depending on the CAN (Choice Answer Number), that number of coins is debited from the players' bank and the Money Piece is moved backward, clockwise on the board 10, the number of spaces equivalent to the CAN (Choice Answer Number).

During the main game phase, a "Match & Move Slam!" can occur when a "Money Fact" card is drawn. The "Match & Move Slam!" typically occurs when three things happen: a Current Players' Money Piece (such as a dime) sits on a Money Space (typically a space in one of sides 20, 22, 24, and 26) having the same Child President/Person (Franklin D. Roosevelt) on the board 10 and a "Money Fact" card asks a question about either a dime or Franklin D. Roosevelt. A "Match & Move Slam!" can also occur when a Current Player's Money Piece (such as a dime) sits on a "Match & Move Wild" space in one of sides 20, 22, 24, and 26, and a "Money Fact" card is drawn asking a question about either a dime or Franklin D. Roosevelt.

For CAN (Choice Answer Number) 1-3, if answered correctly, the player rolls the Coin Die and depending on the CAN (Choice Answer Number) chosen, triples the number of coins on the Coin Die that are deposited into the players' bank (into one of 42, 44, 46, or 48) and the Money Piece is triple moved counterclockwise on the board 10 the number of spaces equivalent to the number.

If answered incorrectly, the player rolls the Coin Die and depending on the CAN (Choice Answer Number), triples the number of coins that are debited from the players' bank (from one of 42, 44, 46, and 48) and the Money Piece is triple moved backward the number of spaces equivalent to the CAN (Choice Answer Number).

If CAN (Choice Answer Number) 4 is chosen, meaning the Current Player didn't need any help, and the question is answered correctly, the Current Player rolls the Coin Die and depending on the CAN (Choice Answer Number) chosen, quadruples the number of coins that are deposited into the players' bank (into on of 42, 44, 46, or 48), slams the Money Piece to the Dollar Finish Base, such as 18*b*, and slams another money piece on the previous space.

If answered Incorrectly, the Current Player rolls the Coin Die and depending on the CAN (Choice Answer Number), quadruples the number of coins that are debited from the players' bank (one of 42, 44, 46, and 48) and Slams the Money Piece back to the Cents Start Base, such as 16*a.*

The Match & Move Slam! is the element of chance and can greatly increase or decrease the players' chance of winning multiple awards.

The game continues until the first player moves all of his or her Money Pieces (Level 1=1 money piece per player, Level 2=2 money pieces per player, Level 3=3 money pieces per player, Level 4=4 money pieces per player) to the Dollar Finish Base or space 18*b* on board 10. The player who moves all of his or her Money Pieces to the Dollar Finish Base or space 18*b* receives a Money Pieces Finisher award. A player only has the opportunity to purchase their item after all Money Pieces are in the Dollar Finish Base 18*b* Then the game goes into the Count Phase.

C. The Count

The Count phase determines if the Money Pieces Finisher has enough money to purchase the item and also receive the Purchaser award. This phase also determines which player has the most money and receives the Most Money award. If the Money Pieces Finisher has enough money to purchase the Item and also has the most money, that player, in one embodiment receives three awards (Money Piece Finisher, Most Money, Purchaser). To make this determination, all players set up their coins from the greatest to the smallest amount.

The player on the left (clockwise) of the Money Pieces Finisher chooses a Choice Answer Numbers 1-3 to count the coins.

1. I need help. Either the Match & Move Monitor or another player helps with the count.
2. I will count using Match & Move.
3. I will answer without Match & Move—using Match & Move, I'll prove my answer.

After each player counts the coins, each player writes the number or total amount of money on the card and leaves the card face up. If the Money Pieces Finisher has earned enough money to purchase the Item, that player receives "The Purchaser" award. This player or the player with the most money receives the Most Money award. All players turn their cards face down. Then the game goes into the Exchange Phase.

D. The Exchange In the Exchange Phase, all players again set up the coins in groups. The player to the left of the player to receive the Most Money award exchanges smaller denominations for larger denominations. A player can choose to use the Count Guide, such as 30 shown in FIG. 1 or 130 shown in FIG. 2. For example, in Level 1 pennies are exchanged for nickels, nickels are exchanged for dimes. The players choose a Choice Answer Number (CAN) 1-3 to count the exchanged coins.

1. I need help. Either the Match & Move Monitor or another player helps with the count.
2. I will count using Match & Move.
3. I will answer without Match & Move—using Match & Move, I'll prove my answer.

After counting the coins, the coins are placed in an area so that they will not be mixed with the coins earned in the Continuation phase. Each player writes his or her total on the other side of the paper. After all players have written the total of the exchanged coins, each player whose number matches on both sides of the paper receives an Exchange Award.

E. The Purchase

If the Money Pieces Finisher has earned enough money to purchase the item, the Purchaser honor is awarded and the game ends. If the Money Piece Finisher doesn't have enough money to purchase the item, the game goes into The Continuation Phase.

F. The Continuation

If the first Money Pieces Finisher doesn't have enough money to purchase the item, the game goes into the continuation phase. In this phase, the game continues with the player to the left of the Money Pieces Finisher drawing a card and passing it to the Reader, the player to the right to read. All monies earned will be kept separately from monies earned in the earlier game phase. The game continues until the second player moves all their Money Pieces to the Dollar Finish Base 18*b* This player also receives a MONEY PIECES FINISHER award and the game again goes into the Count phase. Only the new coins earned are counted and exchanged. Then this money is added to the prior total. Each player calculates the total to determine if the second player now has enough money to purchase the item. If this player doesn't have enough money to purchase the item, and the prior Money Pieces Finisher now has earned enough money, the item is purchased and the game ends. If neither player has earned enough money to purchase the item, the game again goes into the Continuation phase. This process continues until the item is purchased and the game ends.

G. The Awards Phase

When the game ends, each child can receive one or more of the following awards:

Money Pieces Finisher—one or more awards
Purchaser—typically only one award
Most Money—one or more award
Exchanger—one or more awards
Match & Move Slam!—one or more awards Levels Listed below are the four possible levels in one or more embodiments of the present invention which may be called "Money Match & Move". Each level typically includes U.S. Money and World Money questions. Each level introduces new presidents/people. Any denomination that is repeated in a subsequent level is more advanced. Each level may use a level appropriate coin die to be used with "Money Fact" cards.

Level 1—"Money Counting" cards can include coin-counting questions from 1¢ to 10¢. "Money Fact Cards" can include questions about the Abraham Lincoln/penny, Thomas Jefferson/nickel, Franklin Delano Roosevelt/dime, or U.S. Money and World Money. Basic questions about George Washington/quarter and John F. Kennedy/fifty cent may be introduced. This level uses a die that may have six sides including two penny sides, two nickel sides, two dime sides for the presidents/money counting used in this level.

Level 2—"Money Counting" cards can include coin-counting questions from 10¢ to 25¢. "Money Fact" Cards can include questions about the Abraham Lincoln/penny, Thomas Jefferson/nickel, Franklin Delano Roosevelt/dime, George Washington/quarter and John F. Kennedy/fifty cent, U.S. Money, and World Money. Basic questions about Susan B. Anthony/dollar coin, Sacagawea/dollar coin, and Dwight D. Eisenhower/dollar coin may be introduced. This level uses a die that has six sides, one penny side, one nickel side, one dime side, and one quarter side for the presidents/money counting used in this level. 2 sides will be blank.

Level 3—"Money Counting" cards can include coin-counting questions from 50¢ to 75¢. "Money Fact" Cards can include questions about the Abraham Lincoln/penny, Thomas Jefferson/nickel, Franklin Delano Roosevelt/dime, George Washington/quarter, John F. Kennedy/fifty cent, Susan B. Anthony/dollar coin, Sacagawea/dollar coin, and Dwight D. Eisenhower/dollar coin, U.S. Money and World Money. Basic questions about George Washington/one dollar, Thomas Jefferson/two dollar, Abraham Lincoln/five dollar, and Hamilton/ten dollar may be introduced. This level uses a die that has six sides, one penny side, one nickel side, one dime side, one quarter side, one fifty cent side, and one dollar coin for the presidents/money counting used in this level.

Level 4—"Money Counting" cards can include coin-counting questions from numbers from 75¢ to $1.00. "Money Fact" Cards can include questions about the Abraham Lincoln/penny, Thomas Jefferson/nickel, Franklin Delano Roosevelt/dime, George Washington/quarter, John F. Kennedy/fifty cent, Susan B. Anthony/dollar coin, Sacagawea/dollar coin, and Dwight D. Eisenhower/dollar coin, George Washington/one dollar, Thomas Jefferson/two dollar, Abraham Lincoln/five dollar, Alexander Hamilton/ten dollar, Andrew Jackson/twenty dollar, U.S. Grant/fifty dollar, Benjamin Franklin/hundred dollar, William McKinley/five hundred dollar, Grover Cleveland/one thousand dollar, Salmon P. Chase/ten thousand dollar, Woodrow Wilson/one hundred thousand dollar, U.S. Money, World Money. This level uses a die that has six sides, one penny side, one nickel side, one dime side, one quarter side, one fifty cent side, and one dollar coin for the presidents/money counting used in this level.

The "Match & Move Slam!" adds excitement and an element of chance and happens when three things match: the money piece, the child/president space in one of sides 20, 22, 24, and 26, and the "Money Fact" card. It can also happen when any money piece sits on a M&M wild space of sides 20,

22, 24, or 26 and a Money Fact Card is drawn. Depending on CAN (Choice Answer Number) 1 to 3, if answered correctly, the number of moves triples forward and the coin value on the coin die triples. However, for CAN (Choice Answer Number) 4, the player slams the money piece to the Dollar Finish Base space 18*b* and slams another money piece on its space and coin on the coin die quadruples. If answered incorrectly, depending on CAN (Choice Answer Number) 1 to 3, the number of moves triples forward or backward and the coin value on the coin die is debited triple times the value from the player's bank. However, for CAN (Choice Answer Number) 4, the player slams the money piece back to the cent start base 16*a* and the coin on the coin die is quadruple debited from the player's bank, such as one of 42, 44, 46, or 48.

The first player to move their money pieces to the Dollar Finish Base space 18*b* can purchase the item, providing enough money is earned. If not, the game continues until the item is purchased. When the game ends, numerous honors are awarded, such as: Money Pieces Finisher—one or more awards; Purchaser—typically only one award; Most Money—one or more award; Exchanger—one or more awards; Match & Move Slam!—one or more awards.

A "Money Match & Move" game in accordance with one or more embodiments of the present invention can be a supplemented both in school and at home. It can be also be a learning tool for the child who learns differently. It's a game where parent and child can play together, older siblings can help younger siblings, and children of different levels can play together, helping each other in a confidence-building, rewarding way.

In one embodiment of the present invention, a match and move technique is used to help players count coins. Players can (1) find the total value of a given number of coins by starting with the greatest value coins and matching and moving to the smallest value coins—forward from the top to the bottom on the coin guide 30 in FIG. 1 or 130 in FIG. 2 or (2) find what coins are in a number value by starting with that number value in the smallest value section, penny 30*g* or 130*g*, and matching and moving through to the greatest value section, such as dollar 30*a* or 130*a*—backwards from the bottom to the top of the coin guide 30 or 130.

The forward counting method is used when counting the coins to receive a total, counting from the dollar coin to the penny. The first step is to set up the coins in groups, such as in sections 30*a-g*, or 130*a-g*, from the greatest coin value group to the smallest coin value group (eg. $1 (one dollar), 50¢ (fifty cent piece), 25¢ (quarter), 10¢ (dime), 5¢ (nickel), and 1¢ (penny). The objective is to count the coins in the groups using the coin guide 30 or 130 moving from the coins in the greatest value coin group to the coins in the smallest value coin group. The first coin in the greatest amount section group is placed on the first coin space, such as in one of sections 30*a-g* or 130*a-g* in that group's section on the Match & Move Coin Guide or section 30 or 130. This is the value of the coin. If the next coin is in that group, it is placed in the next space, which is the next value.

If the next coin is of a different group, it constitutes a "Match & Move". The player must match the number that the coin sits of the last coin placed in the previous section to the same number in the new section. The identical number value in both sections is the matching relationship number that the two coins share. After placing the coin on the matching number, the coin is moved over one space. This matching & moving continues until the last coin is placed, with the number above the coin being the value of all coins placed.

The counting backward method is used when the player is given a number and asked to give the coins that could equal or make up that number. The player begins in the smallest value section, the penny, and uses the Match & Move technique in reverse working backwards to the dollar section. The first step is to look for the given number value in the Penny Section. The player takes a penny from the coin tray and places it on the number value. For example, for 7¢, the player would place a penny on the circle under 7¢ in the section 130*g* shown in FIG. 2. The player then would typically continue placing pennies backwards (on the circle under 6¢, then the circle under 5¢, etc.), until the player sees a number (remember it) with color coded circle(s). For example, at 5¢, there may be a color circle in the pennies section 130*g*, corresponding to the color for the circle under 5¢ in the nickel section 130*f*. The identical number value, 5¢, in both sections is the matching relationship number that they share. At this point, it is your decision which coin you wish to continue with by choosing the color you wish to use next. I.e. a coin can be placed on the circle under 5¢ in the nickel section 130*f*. Look to the left of the coin guide 30 or 130 for the section that has that color. Take that coin from the coin tray (such as a nickel), for the new section (such as nickel section 130*f*) you will continue in. Match the number in the previous section with the coin and move it over to the new section, on the identical number (in this example 5¢), and place it there. Continue placing the same coin until you encounter a color coded circle and match and move the new coin in the new section on the same number. Continue in this manner until you reach the first or the leftmost coin space in any section (in this example the 5¢ coin space in nickel section 130*f*) and can go no further. All coins placed on the board 10 will make up the coins that constitute that number. For the seven cents example, a nickel will be placed in the nickel section 130*f* on the circle under 5¢ and pennies will be placed on the circles under 6¢ and 7¢ in the pennies section 130*g*. Use the counting forward method to prove that the coins will give the correct coin count.

At each connecting corner is a square space divided diagonally for the cent start base 16*a* and dollar finish base 18*b*, which can hold up to four money pieces each, such as in holes 17*a* or 17*b*. Below the border, between the cent start base 16*a* and the dollar finish base 18*b* is a space for the bank, such as 42, 44, 46, and 48. The coin guide or section 30 or 130 is typically in the center of the board 10 and in the center of the substantially square shape formed by sides 20, 22, 24, and 26.

Typically the money pieces or game pieces will have the front and back of a coin (such as a quarter, dime, nickel) or a currency (such as the one dollar bill). These money pieces may not actually be real money, such as real U.S. coins or currency, but rather game pieces with depictions of the front and back of real money.

There may be sixteen permanent money pieces, four per player, with eighty coverings, which may be four times twenty for each denomination (quarter, dime, nickel, penny) or there may be eighty permanent money pieces.

There may be a "Question Box", not shown, for holding cards, which may be separate from game board 10. The "Question Box" may include "Money Counting" question cards and "Money Fact" question cards.

There may be a coin tray with coins and currency, which is not shown.

There may be a currency exchange guide showing that five $1 bills exchanges for one $5 bill, five $1 bills and one $5 bill exchanges for $10, two $5 bills exchanges for a $10 bill, ten $1 bills exchanges or one $10 bill, two $10 bills exchanges for one $20.00 bill, etc.

There may be a coin exchange guide showing that five pennies exchange for one nickel, one nickel and five pennies exchange for one dime, two nickels exchanges for one dime, ten pennies exchange for one dime, etc.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a board for playing a game;

wherein the board includes a first path which begins with a start space and ends with an end space;

wherein, in addition to the start space and the end space, there are a plurality of further spaces along the first path leading from the start space to the end space;

wherein a first space of the plurality of further spaces along the first path has a depiction indicating a first denomination of a real national currency;

wherein a second space of the plurality of further spaces along the first path has a depiction indicating a second denomination of the real national currency;

wherein the board includes a counting section for counting one or more items of the first denomination and the second denomination of the real national currency;

wherein the counting section includes a first sub section having a plurality of first sub section spaces, a first space of the plurality of first sub section spaces indicating the value of a single unit of the first denomination of the real national currency, a second space of the plurality of first sub section spaces, adjacent to the first space of the plurality of first sub section spaces, and indicating the value of two units of the first denomination of the real national currency, wherein the counting section includes a second sub section having a plurality of second sub section spaces, a first space of the plurality of second sub section spaces indicating the value of a single unit of the second denomination of the real national currency, a second space of the plurality of second sub section spaces, adjacent to the first space of the plurality of second sub section spaces, and indicating the value of two units of the second denomination of the real national currency;

wherein the first denomination is different from the second denomination;

wherein the board includes a second path comprised of a plurality of spaces;

wherein a first space of the plurality of spaces along the second path has a depiction indicating the first denomination of the real national currency;

wherein a second space of the plurality of spaces along the second path has a depiction indicating a second denomination of the real national currency;

and wherein each of the depictions of the plurality of spaces along the second path show an individual as a child, wherein an adult image of the individual appears on the first or second denomination of the real national currency;

and each of the depictions of the plurality of further spaces along the path show an individual as an adult, wherein an adult image of the individual appears on the first or second denomination of the real national currency.

2. The apparatus of claim 1 wherein the first denomination of the real national currency is any one of the group of a United States penny, nickel, dime, quarter, half dollar coin, or dollar coin; and the second denomination of the real national currency is any one of the group of a United States penny, nickel, dime, quarter, half dollar coin, or dollar coin, with the exception that the first denomination is different from the second denomination.

3. The apparatus of claim 1 wherein the first path substantially surrounds the counting section.

4. The apparatus of claim 1 further comprising a first plurality of game cards; and wherein each game card of the first plurality of game cards has a question and an answer involving money counting concerning the real national currency.

5. The apparatus of claim 1 further comprising a first plurality of game cards; and wherein each game card of the first plurality of game cards has a question and an answer concerning a person whose depiction appears on the first or second denomination of the real national currency.

6. The apparatus of claim 5 further comprising a second plurality of game cards; and wherein each game card of the second plurality of game cards has a question and an answer involving money counting concerning the real national currency.

7. The apparatus of claim 1 wherein the first space of the plurality of further spaces along the first path has a first background which is not part of the depiction indicating the first denomination, and wherein the first background has a first color;

wherein the second space of the plurality of further spaces along the first path has a second background which is not part of the depiction indicating the second denomination, and wherein the second background has a second color which is different from the first color;

wherein each of the plurality of first sub section spaces of the counting section includes the first color; and wherein each of the plurality of second sub section spaces of the counting section includes the second color.

8. The apparatus of claim 1 wherein a third space of the plurality of further spaces along the first path has a depiction indicating a third denomination of a real national currency;

wherein the counting section is for counting one or more items of the first, second, and third denominations of the real national currency;

wherein the counting section includes a third sub section having a plurality of third sub section spaces, a first space of the plurality of third sub section spaces indicating the value of a single unit of the third denomination of the real national currency, a second space of the plurality of third sub section spaces, adjacent to the first space of the plurality of third sub section spaces, and indicating the value of two units of the third denomination of the real national currency; and and wherein the first, second, and third denominations are different.

9. The apparatus of claim 8 further comprising a six sided die comprised of a first side which has a depiction of the first denomination of the real national currency;

a second side which has a depiction of the second denomination of the real national currency; and a third side which has a depiction of the third denomination of the real national currency.

10. A method of playing a game comprising asking a first player a plurality of counting money questions, wherein the plurality of counting money questions concern the counting of items of money of a real national currency;

having the first player answer the plurality of counting money questions; and moving a money piece of the first player along a first path located in a tangible medium a number of spaces which is dependent on whether the first player's answers to the plurality of counting money questions are correct or incorrect;

wherein the first path begins with a start space and ends with an end space;

wherein, in addition to the start space and the end space, there are a plurality of further spaces along the first path leading from the start space to the end space;

wherein a first space of the plurality of further spaces along the first path has a depiction indicating a first denomination of the real national currency; and wherein a second space of the plurality of further spaces along the first path has a depiction indicating a second denomination of the real national currency;

and further comprising having the first player use a counting section in the tangible medium for counting one or more items of the first denomination and the second denomination of the real national currency;

wherein the counting section includes a first sub section having a plurality of first sub section spaces, a first space of the plurality of first sub section spaces indicating the value of a single unit of the first denomination of the real national currency, a second space of the plurality of first sub section spaces, adjacent to the first space of the plurality of first sub section spaces, and indicating the value of two units of the first denomination of the real national currency, wherein the counting section includes a second sub section having a plurality of second sub section spaces, a first space of the plurality of second sub section spaces indicating the value of a single unit of the second denomination of the real national currency, a second space of the plurality of second sub section spaces, adjacent to the first space of the plurality of second sub section spaces, and indicating the value of two units of the second denomination of the real national currency;

wherein the first denomination is different from the second denomination;

wherein providing a second path in the tangible medium comprised of a plurality of spaces;

wherein a first space of the plurality of spaces along the second path has a depiction indicating the first denomination of the real national currency;

wherein a second space of the plurality of spaces along path has a depiction indicating a second denomination of the real national currency;

and wherein each of the depictions of the plurality of spaces along the second path show an individual as a child, wherein an adult image of the individual appears on the first or second denomination of the real national currency;

and each of the depictions of the plurality of further spaces along the first path show an individual as an adult, wherein an adult image of the individual appears on the or second denomination of the real national currency.

11. The method of claim 10 wherein the first denomination of the real national currency is any one of the group of a United States penny, nickel, dime, quarter, half dollar coin, or dollar coin; and the second denomination of the real national currency is any one of the group of a United States penny, nickel, dime, quarter, half dollar coin, or dollar coin, with the exception that the first denomination is different from the second denomination.

12. The method of claim 10 wherein the first path substantially surrounds the counting section.

13. The method of claim 10 further comprising asking the first player a plurality of money fact questions concerning a person whose depiction appears on the first or second denomination of the real national currency;

having the first player answer the plurality of money fact questions; and moving the money piece of the first player along the first path a number of spaces which is dependent on whether the first player's answers to the plurality of money fact questions are correct or incorrect.

14. The method of claim 13 wherein if the money piece of the first player lands on a specific space of the plurality of further spaces along the first path, wherein the specific space has a depiction of a denomination of the real national currency which is the same as a denomination represented by the money piece, and at the same time a money fact question is asked of the first player which concerns a question about the same denomination of the specific space, then the number of spaces that the money piece is moved along the first path is changed by a factor.

15. The method of claim 10 wherein the first space of the plurality of further spaces along the first path has a first background which is not part of the depiction indicating the first denomination, and wherein the first background has a first color;

wherein the second space of the plurality of further spaces along the first path has a second background which is not part of the depiction indicating the second denomination, and wherein the second background has a second color which is different from the first color;

wherein each of the plurality of first sub section spaces of the counting section includes the first color; and wherein each of the plurality of second sub section spaces of the counting section includes the second color.

16. The method of claim 10 wherein a third space of the plurality of further spaces along the first path has a depiction indicating a third denomination of a real national currency;

wherein the counting section is for counting one or more items of the first, second, and third denominations of the real national currency;

wherein the counting section includes a third sub section having a plurality of third sub section spaces, a first space of the plurality of third sub section spaces indicating the value of a single unit of the third denomination of the real national currency, a second space of the plurality of third sub section spaces, adjacent to the first space of the plurality of third sub section spaces, and indicating the value of two units of the third denomination of the real national currency; and and wherein the first, second, and third denominations are different.

17. The method of claim 10 further comprising after asking the first player each money counting question, asking the first player for an indication of the first player's confidence in knowing or not knowing a correct answer to each money counting question; and wherein the number of spaces that the first player's money piece is moved along the first path is dependent on the indication of the first player's confidence in knowing or not knowing a correct answer to each money counting question.

18. The apparatus of claim 1 further comprising a six sided die comprised of:

a first side which has a depiction of the first denomination of the real national currency; and a second side which has a depiction of the second denomination of the real national currency.

* * * * *